United States Patent [19]

Wooding

[11] 4,352,189

[45] * Sep. 28, 1982

[54] ATMOSPHERE CONTROL OF SLAG MELTING FURNACE

[75] Inventor: Patrick J. Wooding, Moorestown, N.J.

[73] Assignee: Wooding Corporation, Moorestown, N.J.

[ * ] Notice: The portion of the term of this patent subsequent to May 13, 1997, has been disclaimed.

[21] Appl. No.: 83,585

[22] Filed: Oct. 11, 1979

Related U.S. Application Data

[63] Continuation-in-part of Ser. No. 773,263, Mar. 1, 1977.

[51] Int. Cl.[3] ..... F27D 7/06

[52] U.S. Cl. ..... 373/45; 373/77

[58] Field of Search ..... 13/9 R, 9 ES, 31

[56] References Cited

U.S. PATENT DOCUMENTS

| | | | |
|---|---|---|---|
| 3,973,076 | 8/1976 | Scott, Jr. et al. | 13/35 |
| 4,027,095 | 5/1977 | Kishida et al. | 13/9 R |
| 4,125,145 | 11/1978 | Medovar et al. | 13/9 ES X |
| 4,202,997 | 5/1980 | Wooding | 13/9 ES |

*Primary Examiner*—Roy N. Envall, Jr.

*Attorney, Agent, or Firm*—Duffield & Lehrer

[57] ABSTRACT

An electrically conductive refractory lined crucible is covered by a refractory lined roof. At least one electrode supported by the roof extends downwardly into the crucible for melting the flux within the crucible. The crucible lining itself functions as the second electrode. The roof and the crucible are air-tight thereby preventing air from entering the crucible. An exhaust port located in the upper portion of the roof is connected to a vacuum device for exhausting fumes from the crucible and for controlling the atmosphere within the crucible.

30 Claims, 2 Drawing Figures

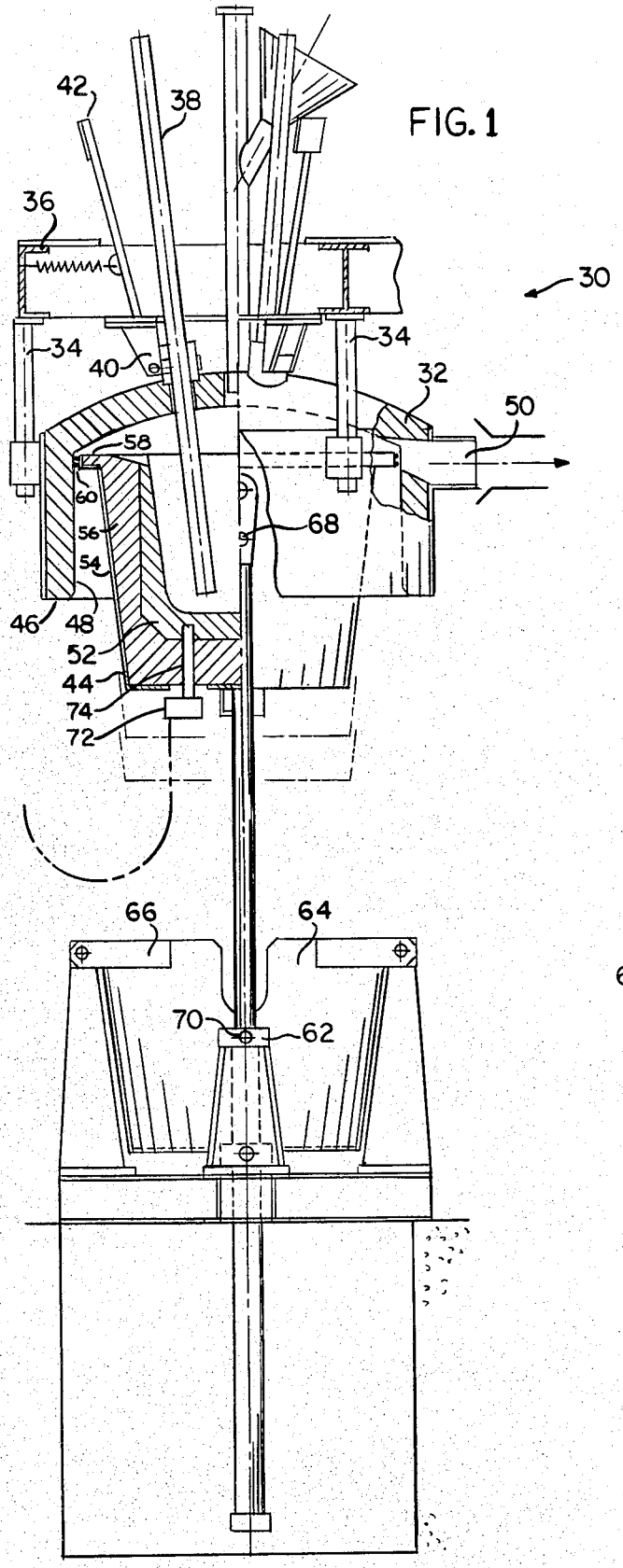
FIG. 1
FIG. 2
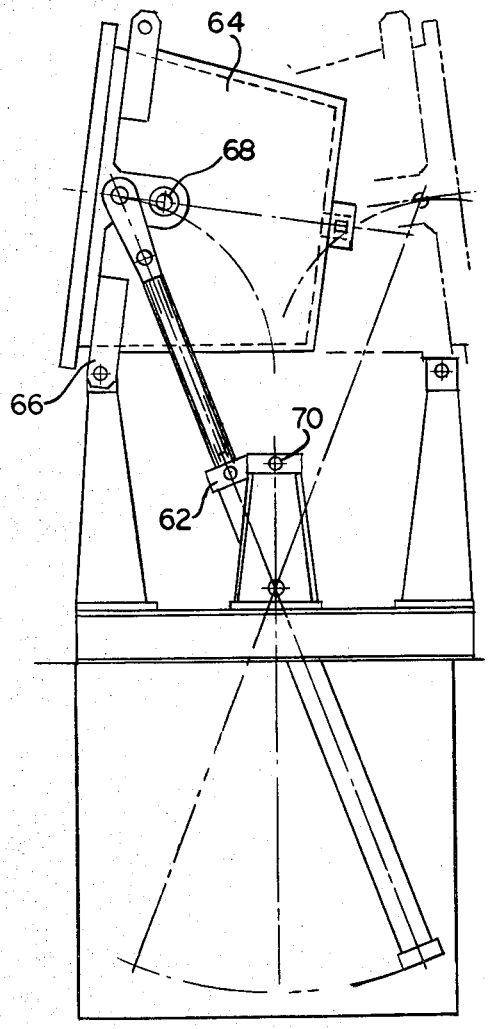

ATMOSPHERE CONTROL OF SLAG MELTING FURNACE

CROSS REFERENCE TO RELATED APPLICATION

This application is a continuation in part of prior co-pending application Ser. No. 773,263 filed Mar. 1, 1977. The subject matter of that prior application is incorporated herein, by reference, in its entirety.

BACKGROUND OF THE INVENTION

The present invention is directed toward a flux or slag melting furnace and more particularly toward such a furnace which includes means for controlling the atmosphere therein and which includes novel electrode means. The furnace described in Applicant's prior co-pending application Ser. No. 773,263 was originally designed for use as a slag pre-melting furnace to be used with a consumable electrode electroslag melting furnace. That invention and the present one are not limited to such use.

The electroslag melting process was first invented, developed and put into full production by R. K. Hopkins in the United States during the period between 1930 and 1960. This process employs a consumable electrode which is immersed in a pool of molten slag supported at the top of the resultant solidifying ingot enclosed within a cold-walled mold or crucible.

Alternating (or sometimes direct) current flows down the consumable electrode through the slag, down the ingot and back to the power supply. Preferably, the current flows back to the power supply in a coaxial manner to the top of the crucible such as shown in U.S. Pat. No. 4,032,705. This current, normally in the range of 1,000 amps per inch of ingot diameter, drops from fifteen to forty volts across the slag (or flux) pool thereby producing hundreds of kilowatts of melting power which consumes the tip of the electrode.

As a result of the foregoing, molten metal droplets form on the immersed electrode tip, detach themselves and fall through the molten flux pool to the ingot which is forming there below. As the metal droplets pass through the flux pool, they undergo chemical treatment. Progressive solidification of the ingot formed by this method leads to the physical isotropy and high yield associated with all consumable electrode processes.

As is known in the art, most electroslag ingots of 24 inch diameter and larger are started by pre-melting a slag of suitable chemistry and pouring a six to eight inch deep pool of this molten slag into the bottom of the crucible. The electrode tip is then immersed to a depth of a half an inch or so into this molten pool. The melting current flowing through the molten flux raises its temperature until the electrode begins to melt.

Molten flux (or slag) starting, as this technique is known, gives much higher utilization of the consumable (electroslag) furnace and better ingot yield than "dry" or cold starting because ingot bottom losses are minimized.

In the past, flux or slag melting furnaces have always been open to the atmosphere. These have consisted primarily of air induction furnaces with the graphite crucible acting as a susceptor. More recently, A.C. resistance furnaces have been employed. These include one or more graphite electrodes in a single phase system, or three electrodes in a three phase system for larger units, which electrodes function as submerged melters in a graphite monolithic crucible or graphite brick lining.

These prior art systems, however, have several serious drawbacks. For example, at elevated temperatures (most slags have melting points in the 2,500° to 3,500° F. range) and in the presence of air (or oxygen) graphite erodes quite rapidly which leads to low heat life of the crucibles (20 to 30 heats) and frequent electrode replacement.

Even further, a substantial part of the eroded graphite, from both the lining and the electrodes, dissolves in the molten flux. It is then poured into the electroslag crucible and is transferred to the bottom few inches of the ingot being built up. In the case of a low carbon alloy steel heat, carbon pick-up from this source can easily scrap all or part of the ingot.

SUMMARY OF THE INVENTION

The present invention overcomes the above-described deficiencies in the prior art by providing an electrically conductive refractory lined crucible which is covered by a refractory lined roof. At least one electrode supported by the roof extends downwardly into the crucible for melting the slag within the crucible. The crucible lining itself functions as the second electrode. The roof and crucible are air-tight and thereby seal the interior of the crucible from the outside atmosphere. An exhaust port located in the upper portion of the roof is connected to a vacuum pump or similar device for exhausting the fumes from the crucible and for controlling the atmosphere therein. As a result, electrode and crucible erosion are sharply reduced and carbon pick-up in the molten slag is virtually eliminated.

BRIEF DESCRIPTION OF THE DRAWINGS

For the purpose of illustrating the present invention, there is shown in the accompanying drawings one form which is presently preferred; it being understood that the invention is not intended to be limited to the precise arrangements and instrumentalities shown.

FIG. 1 is a front elevational view, partially in section, of a slag melting furnace constructed in accordance with the principles of the present invention, and FIG. 2 is a view similar to FIG. 1 showing the manner in which the slag may be poured from the crucible.

DETAILED DESCRIPTION OF THE INVENTION

Referring now to the drawings in detail wherein similar reference numerals have been used throughout the several figures to identify similar components, there is shown in FIG. 1 a front elevational view of a slag melting furnace and designated generally as 30.

The slag melting furnace 30 includes an air-tight refractory lined roof or cover 32 which is fixed in position by supports 34 connected to a beam 36. The roof 32 has three 3-inch diameter electrodes passing therethrough, only one such electrode, 38, being shown in detail. The electrodes are preferably made from graphite but may also be comprised of other forms of carbon. It may also be possible to construct the electrodes from other electrically conductive refractory materials.

Electrode 38 is clamped into a sealed electrode holder 40. The extent to which the electrode 38 extends downwardly can be adjusted by use of lever 42 on holder 40. It will be understood that the second and third electrodes are similarly supported by similar electrode holders. The three electrode holders and electrodes are mounted in a triangular pattern symmetrical around the vertical axis of the roof 32.

The three electrodes are inclined slightly toward each other so that their lower ends would touch if the electrodes were slipped downwardly through the holders to an elevation corresponding to the lowest melting position of the bottom of the crucible 44. The roof 32 includes a downwardly extending cylindrical wall portion 46 having an inner surface 48. The roof 32 also includes a port 50 extending through the wall of the roof adjacent the upper part thereof.

Located beneath the roof 32 is the crucible 44. Crucible 44 includes a graphite crucible section 52 which is separated from an outer steel shell 54 of air-tight construction by a refractory/insulation layer 56. While graphite is preferred as the crucible liner material, other electrically conductive refractory materials may also be used. As shown in FIG. 1, the angle of the electrode inclination corresponds with the inverted cone shape of the graphite portion 52 of the crucible 44.

Adjacent the upper end of the crucible 44 is a horizontally extending flange 58. A plurality of air-tight sealing rings such as shown at 60 surround the outer peripheral portion of the flange 58. These are adapted to engage the inner surface 48 of the roof 32 so as to form a seal there between.

By presetting the bases of the electrodes at a distance of approximately two to eight inches apart, immersed electrode resistance melting of the flux located within the crucible 44 is achieved by raising and lowering the crucible. This is accomplished by means of hydraulic cylinders 62. The melting current is thus regulated by the degree of the immersion of the electrodes. This is accomplished without breaking the seal between the horizontal flange 58 and the inside surface 48 of the roof 32.

It is also contemplated that in some applications it may be possible to utilize the electrically conductive refractory crucible lining 52 as one of the electrodes for the purpose of melting the flux or slag. In order to accomplish this, a terminal 72 is mounted on the outer steel shell 54 of the crucible 44 and is electrically connected to the graphite lining 52 by conductor 74. Terminal 72 may, of course, be insulated from the steel shell 54. If the graphite lining 52 is used as one of the electrodes, one or more of the electrodes 38 may be eliminated. As will be apparent to those skilled in the art, if a single phase or direct current system is utilized, only one electrode 38 is needed along with the graphite liner electrode. Additional electrodes 38 may be utilized in multiphase systems.

During the melting of the flux, an evacuation device (not shown) may be connected to the port 50 to remove the fumes which form in the pre-melting furnace 30 and to prevent oxygen or other detrimental gases from entering. It should be understood that a high-velocity fan-powered venturi could be employed if only substantial atmosphere control were desired or a more powerful vacuum system could be employed if complete atmosphere control were desired.

Delivery of molten slag may be achieved by lowering the crucible 44 into the support cradle 64, locking the crucible into the cradle by use of locks 66 and releasing pins 68 and 70 which ensured vertical motion of the crucible during melting. Thereafter, the hydraulic cylinder 62 is again extended causing the crucible 44 to tilt as shown in FIG. 2 thereby pouring the slag from the crucible 44.

The present invention may be embodied in other specific forms without departing from the spirit or essential attributes thereof and, accordingly, reference should be made to the appended claims, rather than to the foregoing specification as indicating the scope of the invention.

I claim:

1. An electric furnace for melting slag comprising a crucible including an electrically conductive refractory liner therein; at least one electrode extending into the interior of said crucible; means for sealing the interior of said crucible from the outside atmosphere; means for removing detrimental gases from within said crucible, and means for connecting said liner to an electrical power source whereby said liner will function as an electrode.

2. The furnace as claimed in claim 1 wherein said at least one electrode is comprised of carbon.

3. The furnace as claimed in claim 2 wherein said at least one electrode is comprised of graphite.

4. The furnace as claimed in claim 1 wherein said liner is comprised of carbon.

5. The furnace as claimed in claim 4 wherein said liner is comprised of graphite.

6. The furnace as claimed in claim 1 wherein said means for removing detrimental gases comprises means for removing oxygen from said crucible.

7. The furnace as claimed in claim 1 wherein said means for removing detrimental gases comprises means for creating a vacuum within said crucible.

8. The furnace as claimed in claim 1 including means for allowing the molten contents of said crucible to be poured therefrom.

9. A process for melting slag comprising the steps of placing the slag in a crucible having an electrically conductive refractory lining; sealing the interior of said crucible from the outside atmosphere and heating said slag by passing an electric current through said slag with the use of at least one electrode submerged in said slag and said crucible lining functioning as another electrode while controlling the atmosphere within said crucible.

10. The process as set forth in claim 9 wherein said submerged electrode is comprised of carbon.

11. The process as set forth in claim 10 wherein said submerged electrode is comprised of graphite.

12. The process as set forth in claim 9 wherein said lining is comprised of carbon.

13. The process as set forth in claim 12 wherein said lining is comprised of graphite.

14. The process as set forth in claim 9 wherein said atmosphere is controlled by removing detrimental gases from said crucible.

15. The process as set forth in claim 9 wherein said atmosphere is controlled by removing oxygen from said crucible.

16. The process as set forth in claim 9 wherein said atmosphere is controlled by creating a vacuum within said crucible.

17. The process as set forth in claim 9 further including the step of pouring the molten slag from said crucible.

18. The process as set forth in claim 9 wherein said current is direct current.

19. In a process for melting slag, the steps of placing the slag in a refractory lined crucible, sealing the interior of said crucible from the outside atmosphere and heating said slag by passing an electric current through said slag with the use of a plurality of electrodes submerged within said slag while controlling the atmosphere within said crucible by removing detrimental gases from said crucible.

20. In a process as set forth in claim 19 wherein said electrodes are comprised of carbon.

21. In a process as set forth in claim 20 wherein said electrodes are comprised of graphite.

22. In a process as set forth in claim 19 wherein said step of removing gases includes removing oxygen.

23. In a process as set forth in claim 19 wherein said step of removing gases includes the step of creating a vacuum within said crucible.

24. In a process as set forth in claim 19 further including the step of pouring the molten slag from said crucible.

25. An electric furnace for melting slag comprising a crucible and means for sealing the interior of said crucible from the outside atmosphere, said crucible including a refractory liner therein; a plurality of electrodes extending into the interior of said crucible, and means for controlling the atmosphere within said crucible by removing detrimental gases therefrom.

26. The furnace as claimed in claim 25 wherein said electrodes are comprised of carbon.

27. The furnace as claimed in claim 26 wherein said electrodes are comprised of graphite.

28. The furnace as claimed in claim 25 further including means for allowing the molten contents of said crucible to be poured therefrom.

29. The furnace as claimed in claim 25 wherein said means for removing gases removes oxygen.

30. The furnace as claimed in claim 25 wherein said means for removing gases includes means for creating a vacuum within said crucible.

* * * * *